United States Patent [19]

Khinkis et al.

[11] Patent Number: 5,020,456

[45] Date of Patent: Jun. 4, 1991

[54] PROCESS AND APPARATUS FOR EMISSIONS REDUCTION FROM WASTE INCINERATION

[75] Inventors: Mark J. Khinkis, Morton Grove; Hamid A. Abbasi, Darien, both of Ill.; Robert A. Lisauskas, Shrewsbury; Daniel C. Itse, Blackstone, both of Mass.

[73] Assignee: Institute of Gas Technology, Chicago, Ill.

[21] Appl. No.: 486,065

[22] Filed: Feb. 28, 1990

[51] Int. Cl.[5] ..... F23J 11/00

[52] U.S. Cl. ..... 110/345; 110/245

[58] Field of Search ..... 110/245, 345, 244

[56] References Cited

U.S. PATENT DOCUMENTS

| | | | |
|---|---|---|---|
| 3,781,162 | 12/1973 | Rudd et al. . | |
| 3,938,449 | 2/1976 | Frisz et al. . | |
| 3,955,909 | 5/1976 | Craig et al. . | |
| 4,013,399 | 3/1977 | Craig et al. . | |
| 4,050,877 | 9/1977 | Craig et al. . | |
| 4,336,469 | 6/1982 | Wysk . | |
| 4,416,418 | 11/1983 | Goodstine et al. | 110/245 |
| 4,538,529 | 9/1985 | Temelli | 110/244 |
| 4,589,353 | 5/1986 | Bauver, II | 110/244 |
| 4,624,192 | 11/1986 | Mansfield | 110/245 |
| 4,628,833 | 12/1986 | O'Hagan et al. | 110/245 |
| 4,646,661 | 3/1987 | Roos et al. | 110/245 |
| 4,672,900 | 6/1987 | Santalla et al. . | |

*Primary Examiner*—Henry C. Yuen

*Attorney, Agent, or Firm*—Thomas W. Speckman; Douglas H. Pauley

[57] ABSTRACT

A furnace for combustion wherein a combustion chamber is configured such that waste can be advanced from a drying zone, to a combustion zone, to a burnout zone, and then into an ash pit. An air source provides air for drying, combustion and burnout in a primary combustion zone (PCZ). Fuel or a fuel/recirculated flue gas mixture is injected above the PCZ to create a mostly reducing substoichiometric secondary combustion zone (SCZ), to reduce $NO_x$ and decompose other nitrogen bearing compounds entering the SCZ. Vitiated air is injected into the combustion chamber above the mostly reducing SCZ. A process for combustion of the waste includes introducing the waste into the combustion chamber, advancing the waste through the combustion chamber, supplying combustion air to the combustion chamber for drying and combusting the waste and final ash burnout, and removing ash products from the combustion chamber. The fuel or fuel/recirculated gas mixture is supplied into the combustion chamber to create substoichiometric conditions for $NO_x$ reduction and nitrogen bearing compounds decomposition. Overfire air is supplied into the combustion chamber above the substoichiometric zone for thorough mixing and at least partial burnout of combustibles contained within the waste/fuel combustion products.

30 Claims, 1 Drawing Sheet

PROCESS AND APPARATUS FOR EMISSIONS REDUCTION FROM WASTE INCINERATION

BACKGROUND OF THE INVENTION

1. Field of the Invention

A process and apparatus for combustion of waste such as municipal solid waste (MSW), refuse derived fuel (RDF) or other comparable solid waste; the process results in simultaneous reduction in nitrogen oxides ($NO_x$), carbon (PCDF), and other organic emissions.

2. Description of the Prior Art

Most of the existing processes and apparatuses for combustion of waste, such as municipal solid waste (MSW) or refuse derived fuel (RDF), include a combustion chamber equipped with a sloped or horizontal stoker that reciprocates or travels to move the waste from the waste inlet side of the combustor to the ash removal side of the combustor. A portion of the combustion air, generally equivalent to 1.0 to 1.3 of the waste stoichiometric requirement, is supplied under the stoker. Such combustion air is typically called undergrate air, or UGA, and is distributed through the stoker to dry and burn the waste present on the stoker. The waste is first dried on the drying portion or drying grate of the stoker, then combusted on the combustion portion or combustion grate of the stoker. The residual waste that primarily includes ash and carbon is then decarbonized or burned on the burnout portion or burnout grate of the stoker. The bottom ash is then removed through an ash pit. To assure carbon burnout, a high level of excess air, compared to the amount required for carbon burnout, is maintained at the burnout grate. In addition to other species, the products of waste drying, combustion and burnout contain products of incomplete combustion (PIC's) such as carbon monoxide (CO) and total hydrocarbons (THC), oxides of nitrogen ($NO_x$), such as NO, $NO_2$, $N_2O$ and other nitrogen bearing compounds (NBC's) such as $NH_3$, HCN and the like.

The majority of $NO_x$ evolved from the stoker is believed to form from the oxidation of nitrogen bearing compounds and a smaller portion forms from the oxidation of molecular nitrogen.

Additional air or overfire air (OFA) is usually introduced above the stoker and mixed with the products evolved from the stoker to burnout the combustibles and destroy NBC's. The excess air level downstream of the OFA injection is generally in the range of 60% to 100%. The downstream of the OFA injection zone forming significant additional NOx. Because of the low combustion temperatures in and downstream of the OFA injection most of the NOx formed in this zone is by the oxidation of NBC's (less than about 10%, are formed in this zone by the oxidation of molecular nitrogen). Based on measurements by the inventors, typical mass burn operations would result in about 30% of the total NOx formed on the stoker and about 70% in and downstream of the OFA injection.

In most cases, a boiler is an integral part of the combustor to recover the heat generated by MSW combustion. In some cases, a portion of the cooled flue gases from downstream of the boiler are recirculated back into the combustion zone to reduce oxygen concentration and to lower combustion temperatures and thus are believed to decrease oxides of nitrogen formation. A disadvantage of flue gas recirculation is generally a higher concentration of PIC's within the flue gases and within the stack gases because of reduced combustion efficiency.

U.S. Pat. No. 3,781,162 teaches an apparatus for mixing recirculated flue gases with combustion air before the gases reach an ignitor. The '162 patent discloses combustion without recirculating vitiated air from over a burnout grate for overfiring. The '162 patent teaches neither fluid swirling in the combustion chamber nor injecting fuel above a stoker.

U.S. Pat. No. 3,938,449 discloses a waste disposal facility which uses a rotary kiln that differs from a stoker. The rotary kiln includes a hollow, open-ended circular tube body mounted for rotation about its circular axis. Hot flue gases are recirculated to dehydrate the waste material and remove oxygen. The '449 patent does not disclose fluid swirling in the combustion chamber or fuel injection downstream of the primary waste combustion zone.

U.S. Pat. No. 4,336,469 teaches a method of operating a magnetohydrodynamic (MHD) power plant for generating electricity from fossil fuel. The MHD combustor has a first stage which operates substoichiometrically, second stage natural gas injection, and third stage air injection for complete combustion. The '469 patent does not disclose the use of vitiated air from the combustor for overfiring and does not disclose fluid swirling within the combustion chamber. The '469 patent discloses a dwell U.S. Pat. No. 4,672,900 teaches a tangentially-fired furnace having injection ports for injecting excess air above a fireball of the combustion chamber to eliminate the flue gas swirl as the flue gas flows into a convection section. The furnace uses pulverized coal as a fuel. Secondary air is tangentially injected into the furnace and swirls in the direction opposite of the flue gas swirl. The '900 patent does not suggest the us of recirculated vitiated air from the main combustor for overfiring, fluid swirling within the combustion chamber, or fuel injection downstream of the primary combustion zone.

U.S. Pat. Nos. 4,013,399, 4,050,877 and 3,955,909 teach reduction of gaseous pollutants in combustion flue gas. The '909 patent discloses two-stage combustion within a combustion chamber. Heat removal occurs in the first, second or both combustion stages to reduce nitrogen oxides. Secondary combustion air is injected or diffused through tubes into the stream of gaseous combustion products flowing from a primary combustion chamber to promote mixing and complete combustion without an excessive amount of secondary air.

SUMMARY OF THE INVENTION

It is an object of this invention to provide a process and apparatus for combustion of wastes such as MSW, RDF or other comparable solid waste where fuel, preferably natural gas, is injected above the burning waste providing a sufficient temperature, from about 1600° F. to about 2000° F., and a sufficient length of time, from about 1.0 sec to about 4.0 sec, to create a mostly reducing zone which decomposes nitrogen bearing compounds (NBC's) and reduces nitrogen oxides ($NO_x$) entering the reducing zone to Nz and uses secondary air or overfire air (OFA) to reduce other emissions such as carbon monoxide (CO), total hydrocarbons (THC), dioxins (PCDD), and dibenzofurans (PCDF), without forming significant additional $NO_x$.

It is another object of this invention to inject recirculated flue gases (FGR) from the boiler exit into the mostly reducing zone to enhance mixing, and improve temperature and composition uniformity in the mostly reducing zone.

It is another object of this invention to remove a portion of the combustion products from above the burnout grate or from above the burnout zone, which normally enter the mostly reducing zone, to increase temperature and improve temperature and composition uniformity in the mostly reducing zone, to decrease the necessary amount of reburning fuel and to reduce $NO_x$ emissions.

It is another object of this invention to provide a process and apparatus for combustion of solid wastes using a combination of low excess air or substoichiometric combustion of solid wastes in certain zones within the combustion chamber, above the drying and combustion zones, using flue gas recirculation upstream and/or downstream of the combustion chamber, using fuel injection or a fuel/flue gas mixture injection to provide a mostly reducing zone or secondary combustion zone (SCZ), downstream of the primary combustion zone (PCZ) or above the burning waste for reducing NBC's and $NO_x$, and using secondary air or OFA injection above the reducing zone for final burnout of remaining combustibles in a tertiary combustion zone (TCZ).

It is another object of this invention to remove a significant portion of the combustion products, or vitiated air, from above or downstream of the burnout zone for reinjection downstream of the reducing SCZ.

It is yet another object of this invention to provide a process and apparatus for combustion of solid wastes where flue gases are injected downstream of the combustion chamber, or above the stoker, into the SCZ which thus creates turbulent flow for enhanced mixing, and NBC's decomposition and $NO_x$ reduction. NBC's decomposition and $NO_x$ reduction is further enhanced by tangentially injecting fuel, a fuel/flue gas mixture, and/or flue gases above the stoker to create multiple swirl zones. Similarly, combustible burnout is increased by tangentially injecting the OFA downstream of the reducing SCZ.

A furnace or apparatus for combustion of solid wastes according to this invention includes a plurality of walls which define a combustion chamber. In one embodiment of the present invention, a stoker having at least one drying grate portion, at least one combustion grate portion, and at least one burnout grate portion is located in a lower portion of the combustion chamber. At least one ash pit is located downstream of the burnout grate portion, within the combustion chamber.

At least one solid waste inlet is located in at least one wall of the combustion chamber, in a position such that the waste is introduced into the combustion chamber on the drying grate portion. At least one conduit is in communication with an undergrate air source or a primary combustion air source and a space beneath the stoker and is used to supply undergrate air through the stoker, or through another combustion chamber design.

In one embodiment of this invention, at least one overfire air nozzle (OFA nozzle) is used to supply OFA into the combustion chamber above the stoker. Each OFA nozzle is sealably secured to the combustion chamber wall in a position such that the OF is injected into combustion products within the combustion chamber. At least one nozzle for injecting fuel, a fuel/flue gas mixture, or flue gases is sealably secured to at least one wall of and is in communication with the combustion chamber, above the grate. In a preferred embodiment, each of these nozzles is positioned such that the fluids are tangentially injected into the combustion chamber above the stoker, with respect to the combustion chamber walls. In yet another preferred embodiment, each OFA nozzle is positioned such that OFA is also tangentially injected, with respect to the combustion chamber walls, into the combustion chamber above the reducing zone. Each OFA nozzle is in communication with the combustion chamber.

In one embodiment of this invention, a fan, blower, compressor or other type of air moving or compressing apparatus inlet is mounted within an opening formed within the walls, preferably above the burnout grate portion. The apparatus ejects the vitiated air from above the burnout grate portion and compresses and injects the vitiated air or vitiated/fresh air mixture as a tertiary air through the OFA nozzles.

In one embodiment, at least one OFA nozzle for injecting vitiated air or vitiated air/fresh air mixture is sealably secured to at least one wall of and is in communication with the combustion chamber above the reducing zone. In a preferred embodiment, each OFA nozzle is positioned such that a fluid is tangentially or radially injected into the combustion chamber above the reducing zone, at any angle with respect to the horizontal. In yet another preferred embodiment, the fluid is tangentially injected, with respect to the combustion chamber walls, into the combustion chamber above the reducing zone and through the OFA inlet.

A preferred process for combustion of solid waste according to this invention begins with introducing the waste through the fuel inlet, into the combustion chamber and through a drying zone of the chamber. The waste is advanced within the combustion chamber from the drying zone through the combustion zone and through the burnout zone. In one embodiment of this invention, for stoker firing of MSW, undergrate air is supplied through the stoker for drying and at least partially combusting the waste on the combustion grate, and for burning out ash organics on the burnout grate. Ash is removed from the combustion chamber through at least one ash pit outlet located within the combustion chamber downstream of and in communication with the combustion chamber.

In one preferred embodiment according to this invention, the deficient air level in most (60% to 100% of SCZ volume) of the SCZ is about 0 percent to about 40 percent. In another preferred embodiment, the overall to about 100 percent. In yet another preferred embodiment, flue gases are recirculated for drying and preheating the waste.

In another embodiment of this invention, fuel is injected within the combustion chamber, above the stoker, to provide a mostly (60% to 100% of SCZ volume) reducing SCZ for decomposing NBC's as well as reducing $NO_x$ in the combustion products entering the SCZ. The fuel can be either in a solid, liquid or gaseous form, each of which do not contain significant fuel-bound nitrogen. A preferred fuel is natural gas. The fuel injected into the combustion chamber above the stoker represents about 5 percent to about 40 percent of the waste heating value. The fuel is injected above the stoker in an amount which provides an average stoichiometric ratio of about 0.6 to about 1.05 within the combustion chamber, above the stoker, in the SCZ, with 60% to 100% of the SCZ volume below a stoichiometric ratio of 1.0. In one embodiment of this invention, about 5 percent to about 30 percent of the flue gases from the boiler exhaust are recirculated back into the reducing SCZ.

Vitiated air is ejected from above the burnout grate portion and injected into the combustion chamber, above the reducing SCZ. In one embodiment of this invention, the ejected vitiated air is mixed with fresh air prior to injection. OFA is supplied into the combustion chamber through at least one OFA inlet above the reducing SCZ for thorough mixing and at least partial burnout of combustibles contained within the waste combustion products in a tertiary combustion zone (TCZ), which is downstream of the SCZ. In another embodiment according to this invention, OFA representing about 5 percent to about 50 percent of a total air supply is injected above the reducing SCZ to provide an oxidizing zone.

In one embodiment of this invention, natural gas, flue gases, and/or natural gas/flue gas mixture is injected into the combustion chamber above the stoker and OFA is injected downstream of the stoker. Either gas ca be tangentially or radially injected into the combustion chamber, or can be injected into the combustion chamber at an angle with respect to the horizontal.

DESCRIPTION OF PREFERRED EMBODIMENTS

For purposes of this invention, the term "waste" or "solid waste" is synonymously used throughout this specification and in the claims as municipal solid waste (MSW), refuse derived fuel (RDF) and/or other comparable solid waste. It is conceivable that waste may also have glass, metals, paper and/or plastic removed from the composition (RDF) and still be used as a fuel in the furnace of this invention. $NO_x$ is oxides of nitrogen or nitrogen oxides such NO, $NO_2$, $N_2O$. NBC's are compounds such as HCN and $NH_3$ that can oxidize to $NO_{lx}$, in the presence of oxygen. The secondary combustion zone (SCZ) is the volume of the combustion chamber that is downstream of the primary combustion chamber but below the location of overfire air (OFA) injection. The tertiary combustion zone (TCZ) is the volume of the combustion chamber downstream of the SCZ. The drying grate portion of the stoker also means the drying grate or drying zone and vice versa; and likewise for the combustion and burnout grate portions.

Figure 1:
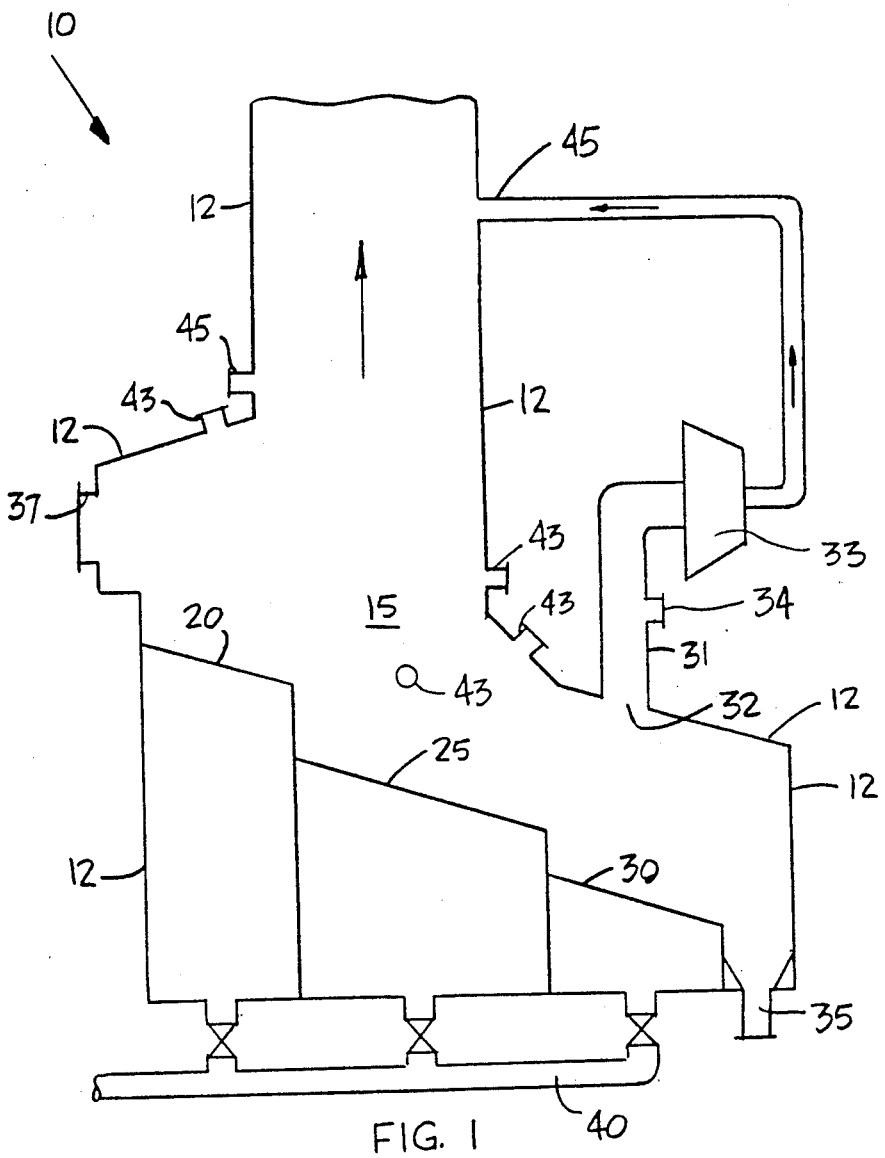
FIG. 1 shows a diagrammatic cross-sectional front view of a furnace for combustion of MSW or other solid waste, according to one embodiment of this invention.

The apparatus for waste combustion, furnace 10, is shown in diagrammatic cross-sectional front view in FIG. 1. A plurality of walls 12 define combustion chamber 15. A stoker generally comprises at least one drying grate portion 20, at least one combustion grate portion 25 and at least one burnout grate portion 30 located within combustion chamber 15, preferably within a lower portion. At least one ash pit outlet 35 is located within combustion chamber 15, downstream of burnout grate portion 30. At least one fuel inlet 37 is positioned in wall 12 above the stoker such that the waste enters combustion chamber 15, then flows onto drying grate portion 20. The waste is advanced from drying grate portion 20, over combustion grate portion 25, over burnout grate portion 30, and then into ash pit outlet 35.

At least one undergrate air conduit 40 is in communication with an undergrate air source and a space beneath at least one of drying grate portion 20, combustion grate portion 25 and burnout grate portion 30. Undergrate air conduit 40 is used to supply undergrate air beneath and then through the stoker. An undergrate air source and at least one space beneath the stoker are in communication with undergrate air conduit 40 and are also used to provide undergrate air beneath and then through the stoker.

At least one fuel/flue gas nozzle 43 is secured to wall 12 and in communication with combustion chamber 15. Each fuel/flue gas nozzle 43 is positioned on wall 12 such that fuel/flue gases are injected into combustion products within combustion chamber 15. At least one overfire air nozzle 45 is sealably secured to wall 12 and in communication with combustion chamber 15. Each overfire air nozzle 45 is secured to wall 12 in such a position that a fluid, preferably vitiated air, is injected into combustion chamber 15, above the reducing SCZ. In a preferred embodiment according to this invention, each overfire air nozzle 45 and each fuel/flue gas nozzle 43 is either positioned or has internal mechanical components known in the art for tangentially or radially injecting each respective fluid into combustion chamber 15, above the reducing SCZ and the stoker, respectively. It is apparent that internal baffles, internal or external nozzles, or the like, can be used to tangentially or radially direct the fluid into combustion chamber 15. Thus, fluid swirl which enhances mixing can be accomplished in combustion chamber 15 having any type of cross section, even a rectangular cross section, as shown in FIG. 3.

Figure 2:
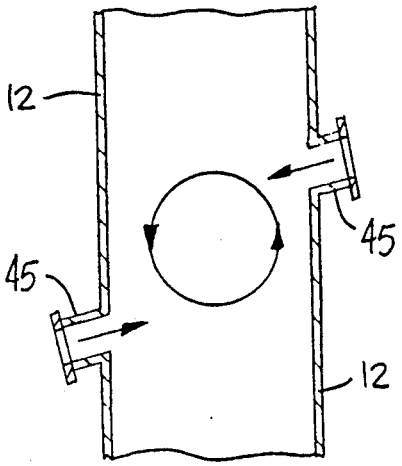
FIG. 2 shows a cross-sectional side view of an upper wall having nozzles secured at an angle with respect to the horizontal, according to one embodiment of this invention.
Figure 3:
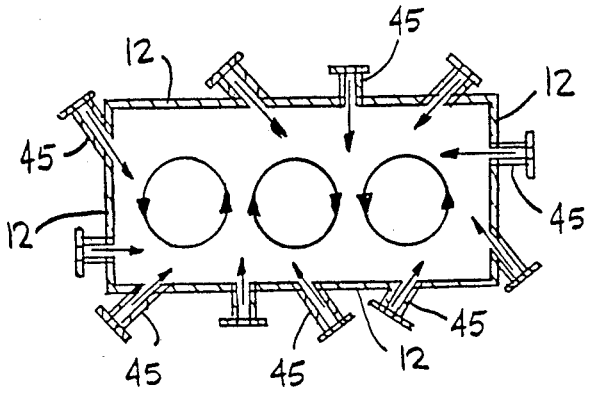
FIG. 3 shows a cross-sectional top view of the upper walls of the combustion chamber having secured nozzles that can be used to tangentially inject a gas, according to one embodiment of this invention.

Referring to FIG. 3, overfire air nozzles 45 can be positioned at angles relative to wall 12 such that at least one swirl, preferably multiple swirls, are formed within combustion chamber 15. It is apparent that the fluid can be injected into combustion chamber 15 at an angle with respect to the horizontal by positioning secondary air nozzle 45 at an angle with respect to the horizontal, as shown in FIG. 2.

In one embodiment according to this invention, at least one induced draft (ID) fan 33 is mounted within exhaust opening 32, which is preferably above burnout grate portion 30. ID fan 33 is used to exhaust vitiated air from above burnout grate portion 30, within combustion chamber 15. In another embodiment according to this invention, ID fan 33 and a discharge nozzle are used to inject the vitiated air into combustion chamber 15, above a reducing SCZ. In a preferred embodiment, the vitiated air is mixed with fresh air and then injected through nozzle 34 as the OFA.

Exhaust opening 32 can be positioned at any suitable location within wall 12, above burnout grate portion 30, preferably within the top section of wall 12, as shown in FIG. 1. Vitiated air duct 31 is sealably secured to wall 12 around exhaust opening 32. It is apparent that ID fan 33 can be a blower, a suction nozzle of a compressor, or any other type of suitable air compressing device or blower means.

A process for combustion of the waste begins with introducing the waste through waste inlets 37 into combustion chamber 15 and onto drying grate portion 20 of the stoker. The waste is further advanced, preferably by reciprocating motion and gravity over combustion grate portion 25 and burnout grate portion 30. Undergrate air is supplied beneath and then through drying grate portion 20, combustion grate portion 25 and burnout grate portion 30 for drying and combusting the waste. Ash products are removed from combustion chamber 15 through ash pit outlet 35 which is located downstream of burnout grate portion 30, within combustion chamber 15. Fuel is injected into combustion chamber 15 above the stoker to form a mostly reducing SCZ (60% to 100% of SCZ volume) for decomposing NBC's as well as reducing NOx entering the SCZ. The fuel can be in either a solid, liquid or gaseous form, any of which contain insignificant amounts of fuel-bound nitrogen. In a preferred embodiment, the fuel is natural gas. The fuel represents about 5 percent to about 25 percent of the waste heating value. The fuel, which is contained in a stream of recirculated flue gases, is injected through at least one fuel/flue gas nozzle 43, as shown in FIG. 1, to provide an stoichiometric ratio of about 0.6 to about 1.05 within combustion chamber 15, above the stoker. Flue gases representing about 5% to about 30% of the flue gases at the boiler exhaust are recirculated and injected into the SCZ to enhance mixing and improve temperature and gas composition uniformity.

In one embodiment of this invention, vitiated air is ejected from above burnout grate portion 30, mixed with fresh air at fresh air nozzle 34, and injected as OFA into combustion chamber 15 above the reducing SCZ. The OFA is preferably injected through at least one overfire air nozzle secured to wall 12 and in communication with combustion chamber 15, above the SCZ.

OFA is supplied into combustion chamber 15 through at least one overfire air nozzle 45 for thorough mixing and at least partial burnout of combustibles contained within the waste combustion products. In a preferred embodiment of this invention, OFA is tangentially or radially injected, with respect to wall 12, into combustion chamber 15, above the reducing SCZ. In one embodiment of this invention, OFA representing about 5 percent to about 50 percent of a total air supply is injected above the reducing SCZ.

OFA is injected above the reducing zone only after allowing a sufficient residence time, preferably about 1 sec. to about 4 secs., in the mostly reducing SCZ for significant decomposition of NBC's and $NO_x$ reduction. The relatively low temperatures in waste combustors. It is apparent that the residence time may vary according to the specific waste, amount of fuel injected and the combustor operating temperature.

In another preferred embodiment according to this invention, the ejected vitiated air is mixed with fresh air prior to injecting into combustion chamber 15, above the SCZ. An air deficiency level achieved in the SCZ is about 0 percent to about 40 percent and the overall excess air level achieved downstream of OFA nozzle 45 is about 40 percent to about 100 percent. In another embodiment according to this invention, flue gas is recirculated for drying and preheating waste on the drying grate portion 20.

In still another preferred embodiment according to this invention, natural gas, flue gases, a natural gas/flue gas mixture, and/or OFA, all generally referred to as a fluid, can be tangentially or radially injected, with respect to wall 12, into combustion chamber 15, above the stoker. In another embodiment according to this invention, the fluid can be injected into combustion chamber 15 above the stoker, at an angle with respect to the horizontal, as shown in FIG. 2.

This invention uses a combination of low excess air or substoichiometric combustion of the waste on the stoker. Natural gas or any other solid, liquid, or gaseous fuel that does not contain significant fuel-bound nitrogen is injected into combustion chamber 15 above the stoker to provide a mostly reducing zone, having a 0.6 to 1.05 average stoichiometric ratio above the stoker, but with 60% to 100% of the SCZ volume at a stoichiometric ratio of less than 1.0, which decomposes NBC's and reduces $NO_x$. OFA is injected above the reducing zone to provide a relatively strong mixing zone which assures high efficiency/low pollutant emission combustion within combustion chamber 15, providing low air emissions such as CO, THC, PCDD and PCDF.

While in the foregoing specification this invention has been described in relation t certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A process for waste combustion comprising the steps of:

(a) introducing the waste into a drying zone within a combustion chamber;

(b) supplying air to the drying zone for preheating, drying, and partially combusting the waste (c) advancing the waste to a combustion zone within the combustion chamber;

(d) supplying air to the combustion zone for further (e) advancing the waste to a burnout zone within the combustion chamber;

(f) supplying air to the burnout zone for final burnout of organics in the waste;

(g) injecting fuel and recirculated glue gases into the combustion chamber above the waste to create a reducing secondary combustion zone;

(h) supplying overfire air into the combustion chamber above the secondary combustion zone for thorough mixing and final burnout of combustibles in combustion products of the waste in a tertiary combustion zone;

ash from the combustion chamber;

(i) removing (j) ejecting vitiated air from the burnout zone; and (k) injecting the vitiated air into the combustion chamber for thorough mixing and final burnout of combustibles in combustion products of the waste in the tertiary combustion zone.

2. A process for waste combustion according to claim 1 further comprising mixing the exhausted vitiated air with fresh air prior to injecting the exhausted vitiated air into the combustion chamber.

3. A process for waste combustion according to claim 1 further comprising maintaining an air deficiency level in the secondary combustion zone of about 0 percent to about 40 percent.

4. At process for waste combustion according to claim 1 further comprising maintaining an overall excess air level downstream of overfire air inlet means at about 40 percent to about 100 percent.

5. A process for waste combustion according to claim 1 further comprising injecting a fuel within the combustion chamber above the waste to provide the reducing secondary combustion zone for reducing at least nitrogen oxides.

6. A process for waste combustion according to claim 5 wherein the fuel is at least one of a solid fuel, a insignificant fuel-bound nitrogen.

7. A process for waste combustion according to claim 5 wherein the fuel is natural gas.

8. A process for waste combustion according to claim 5 wherein the fuel represents about 5 percent to about 40 percent of the waste heating value and the fuel is injected into the combustion chamber to maintain an average stoichiometric ratio of about 0.6 to about 1.05 within the secondary combustion zone.

9. A process for waste combustion according to claim 1 further comprising injecting the overfire air above the secondary combustion zone to provide an oxidizing zone.

10. A process for waste combustion according to claim 9 wherein the overfire air is about 5 percent to about 50 percent of a total air supply.

11. A process for waste combustion according to claim 1 wherein the air is adjusted to provide an average stoichiometric ratio of about 0.6 to about 1.05 in the secondary combustion zone.

12. A process for waste combustion according to claim 1 wherein the fuel contains a fuel-bound nitrogen content that provides an average stoichiometric ratio of about 0.6 to about 1.05 above the waste.

13. A process for waste combustion according to claim 1 further comprising injecting at least one of natural gas, flue gas, natural gas/flue gas mixture, and overfire air above the waste at an angle with respect to a horizontal.

14. A process for waste combustion according to claim 1 further comprising tangentially injecting, with respect to a combustion chamber wall, above the waste at least one of natural gas, flue gas, natural gas/flue gas mixture, and overfire air.

15. A process for waste combustion according to claim 1 further comprising tangentially injecting, with respect to a combustion chamber wall, overfire air into the combustion chamber above the secondary combustion zone.

16. A process for waste combustion comprising the steps of:

(a) introducing the waste into a combustion chamber and a drying grate portion of a stoker;

(b) supplying air to the drying grate portion for preheating, drying and partially combusting the waste;

(c) advancing the waste to a combustion grate portion of the stoker, within the combustion chamber;

(d) supplying air to the combustion grate portion for further combusting the waste;

(e) advancing the waste to a burnout grate portion of the stoker, within the combustion chamber;

(f) supplying air to the burnout grate portion for final burnout of organics in the waste;

(g) injecting fuel and recirculated flue gases above the stoker to create a reducing secondary combustion zone within the combustion chamber;

supplying overfire air into the combustion chamber (h) above the secondary combustion zone for through mixing and final burnout of combustibles in combustion products of the waste in a tertiary combustion zone;

(i) removing ash from the combustion chamber;

(j) ejecting vitiated air from above the burnout grate; and (k) injecting the vitiated air into the combustion chamber for thorough mixing and final burnout of combustibles in combustion products of the waste in the tertiary combustion zone.

17. A process for waste combustion according to claim 16 further comprising mixing the exhausted vitiated air with fresh air prior to injecting the exhausted vitiated air into the combustion chamber.

18. A process for waste combustion according to claim 16 further comprising maintaining an air deficiency level in the secondary combustion zone of about 0 percent to about 40 percent.

19. A process for waste combustion according to claim 16 further comprising maintaining an overall excess air level downstream of overfire air inlet means at about 40 percent to about 100 percent.

20. A process for waste combustion according to claim 16 further comprising injecting a fuel within the combustion chamber above the stoker to provide the reducing secondary combustion zone for reducing at least nitrogen oxides.

21. A process for waste combustion according to claim 16 wherein the fuel is at least one of a solid fuel, a liquid fuel and a gaseous fuel containing relatively insignificant fuel-bound nitrogen.

22. A process for waste combustion according to claim 16 wherein the fuel is natural gas.

23. A process for waste combustion according to claim 20 wherein the fuel represents about 5 percent to about 40 percent of the waste heating value and the fuel is injected into the combustion chamber to maintain an average stoichiometric ratio of about 0.6 to about 1.05 within the secondary combustion zone.

24. A process for waste combustion according to claim 16 further comprising injecting the overfire air above the secondary combustion zone to provide an oxidizing zone.

25. A process for waste combustion according to claim 24 wherein the overfire air is about 5 percent to about 50 percent of a total air supply.

26. A process for waste combustion according to claim 16 wherein the air is adjusted to provide an average stoichiometric ratio of about 0.6 to about 1.05 in the secondary combustion zone.

27. A process for waste combustion according to claim 16 wherein the fuel contains a fuel-bound nitrogen content that an average stoichiometric ratio of about 0.6 to about 1.05 above the stoker.

28. A process for waste combustion according to claim 16 further comprising injecting at least one of natural gas, flue gas, natural gas/flue gas mixture, and overfire air above the stoker at an angle with respect to a horizontal.

29. A process for waste combustion according to claim 16 further comprising tangentially injecting, with respect to a combustion chamber wall, above the stoker at least one of natural gas, flue gas, natural gas/flue gas mixture, and overfire air.

30. A process for waste combustion according to claim 16 further comprising tangentally injecting, with respect to a combustion chamber wall, overfire air into the combustion chamber above the secondary combustion zone.

* * * * *